US006492895B2

(12) United States Patent
Kamoshida et al.

(10) Patent No.: US 6,492,895 B2
(45) Date of Patent: Dec. 10, 2002

(54) VOLTAGE NON-LINEAR RESISTOR, METHOD FOR MANUFACTURING THE SAME, AND VARISTOR USING THE SAME

(75) Inventors: Yukihiro Kamoshida, Yokaichi (JP); Kazutaka Nakamura, Shiga-ken (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/934,404

(22) Filed: Aug. 21, 2001

(65) Prior Publication Data

US 2002/0101325 A1 Aug. 1, 2002

(30) Foreign Application Priority Data

Aug. 21, 2000 (JP) ..... 2000-250082

(51) Int. Cl.[7] ..... H01C 7/10
(52) U.S. Cl. ..... 338/21; 338/20
(58) Field of Search ..... 338/20, 21

(56) References Cited

U.S. PATENT DOCUMENTS 2,150,167 A * 3/1939 Hutchins et al. ..... 338/21
2,916,167 A * 12/1959 Van der Beck, Jr. ..... 338/21
4,147,572 A * 2/1978 Vaadajiv et al. ..... 148/175
4,086,559 A * 4/1978 Knippenberg et al. .... 338/22 R
5,972,801 A * 10/1999 Lipkin et al. ..... 438/770
6,157,290 A * 12/2000 Glatz-Reichenbach et al. .. 338/22 R

* cited by examiner

*Primary Examiner*—Karl D. Easthom
(74) *Attorney, Agent, or Firm*—Dickstein, Shapiro, Morin & Oshinsky, LLP

(57) ABSTRACT

A voltage non-linear resistor which makes a SiC-based varistor exhibiting low apparent relative dielectric constant and the voltage nonlinearity coefficient a at the same level as ZnO-based varistors is provided. The voltage non-linear resistor includes semiconductive SiC particles doped with an impurity, each of the semiconductive SiC particles having an oxide layer formed on the surface thereof. The oxide layer has a thickness in the range of about 5 to 100 nm and has aluminum diffused therein. A method for making the voltage non-linear resistor and a varistor using the same are also provided.

4 Claims, 3 Drawing Sheets

VOLTAGE NON-LINEAR RESISTOR, METHOD FOR MANUFACTURING THE SAME, AND VARISTOR USING THE SAME

BACKGROUND OF THE INVENTION

1. Field of the Invention

The present invention relates to a voltage non-linear resistor, a method for manufacturing the same, and a varistor using the same.

2. Description of the Related Art

Recent trends toward smaller circuits and higher reference frequencies have demanded size reductions of electronic components capable of withstanding higher frequencies. A varistor, which functions as a surge absorber, is one such electronic component.

Conventionally, SiC-based varistors and ZnO-based varistors are known in the art as nonlinear resistors.

Although the conventional ZnO varistors have a voltage nonlinearity coefficient a of several tens, the apparent relative dielectric constant thereof is 200 or more and the electrostatic capacitance must be kept low when using the ZnO varistors.

The conventional SiC varistors, on the other hand, have a low apparent relative dielectric constant. However, the voltage nonlinearity coefficient a thereof is low compared to other types of varistors and is approximately 7 to 8 at most.

SUMMARY OF THE INVENTION

Accordingly, it is an object of the present invention to provide a voltage non-linear resistor for making a varistor having a low apparent relative dielectric constant and a voltage nonlinearity coefficient a at the same level as that of ZnO varistors. A method for making the powder and a varistor using the same are also provided.

To this end, the present invention provides a voltage non-linear resistor including semiconductive SiC particles doped with an impurity. The semiconductive SiC particles have an oxide layer on the surface thereof. The oxide layer has the thickness in the range of about 5 to 100 nm, and aluminum is diffused into the oxide layer.

The present invention also provides a varistor including: a body made of the above-described voltage non-linear resistor; and electrodes provided on the body.

The present invention further provides a method for manufacturing the voltage non-linear resistor. The method includes a steps of forming an oxide layer on the surface of the semiconductive SiC particles; adding one of elemental Al and an Al compound in the semiconductive SiC particles to prepare a mixture, and performing a heat treatment to the mixture in a reducing atmosphere or a neutral atmosphere to diffuse Al into the oxide layer and to form a potential barrier in the oxide layer.

Preferably, the rate of change in weight of the semiconductive SiC particles DM with respect to a specific surface area S ($m^2/g$) of the semiconductive SiC particles satisfies the relationship:

$$0.01\times S2+0.37\times S\leqq DM\leqq 7.34\times S$$

wherein DM (%)={(M2−M1)/M1}×100, M1 represents the weight of the semiconductive SiC particles before the formation of the oxide layer, and M2 represents the weight of the semiconductive SiC particles after the formation of the oxide layer.

Preferably, the thickness of the oxide layer formed on the surface of each of the semiconductive SiC particles is in the range of about 5 to 100 nm.

The step of forming the oxide layer may include performing a heat treatment to the semiconductive SiC particles in an oxidizing atmosphere.

The step of forming the oxide layer on the surface of the SiC particle may include performing oxidation in air at a temperature in the range of about 1,000 to 1300° C. Preferably, the step of diffusing Al into the oxide layer is performed at a temperature in the range of about 1,000 to 1,400° C.

The voltage non-linear resistor manufactured according to the method of the present invention exhibits low apparent relative dielectric constant and has a voltage nonlinearity coefficient a at the same level as the ZnO-based varistors. Thus, the voltage non-linear resistor of the present invention is suitable for the varistor material.

Moreover, the respective conditions for the step of forming an oxide layer on the surface of a SiC particle and for the step of diffusing Al into the oxide layer can be controlled separately. Thus, the stability of the characteristics can be improved.

DESCRIPTION OF THE PREFERRED EMBODIMENTS

The preferred embodiments of a voltage non-linear resistor, a method for manufacturing the same, and a varistor using the same will be explained below by way of examples.

EXAMPLE 1

As shown in Table 1, n-type-semiconductor SiC powders were prepared by doping each of four types of SiC powders A to D, having different particle diameters and specific surface area, with 4,000 ppm of nitrogen (N) as an impurity. A thermal oxidation treatment (hereinafter, "oxidation") was then performed under the conditions shown in Table 2 in order to form an oxide layer on the surface of a SiC particle.

TABLE 1

| | Powder A | Powder B | Powder C | Powder D |
|---|---|---|---|---|
| Average particle diameter (mm) | 0.3 | 3.02 | 20.10 | 98.4 |
| Specific surface area ($m^2/g$) | 18.03 | 1.53 | 0.31 | 0.14 |

TABLE 2

| Oxidation temperature (° C.) | Heating time | Atmosphere |
|---|---|---|
| 800 | 2 h | Air |
| 900 | 2 h | Air |
| 1000 | 2 h | Air |
| 1050 | 2 h | Air |
| 1100 | 2 h | Air |
| 1150 | 2 h | Air |
| 1200 | 2 h | Air |
| 1300 | 2 h | Air |
| 1350 | 2 h | Air |

An aluminum hydroxide sol and an amorphous silica sol, each reduced to $Al_2O_3$ and $SiO_2$ for calculation purposes, were blended at a ratio of $Al_2O_3$ mol/$SiO_2$ mol=3/2, and the mixture was thoroughly mixed to prepare a mixture sol. The resulting mixture sol was added to each of the SiC powders oxidized under the conditions shown in Table 2 at such an amount that Al contained in the mixture sol was 1 percent by weight relative to 100 percent by weight of the SiC powder. Pure water at 100 percent by weight was then added to the mixture to prepare a slurry. The slurry was thoroughly mixed, dried, and subjected to heat treatment in an Ar atmosphere at 1,150° C. (hereinafter, referred to as "Al diffusion process"). It is to be noted here that when the Al diffusion process was performed, Al diffused in the oxide layer formed on the surface of the SiC particle and in the vicinity of the surface of the SiC particle. The resulting powder was then graded or made substantially the same size. The resulting powder is hereafter referred to as "voltage non-linear resistance powder".

Figure 1:
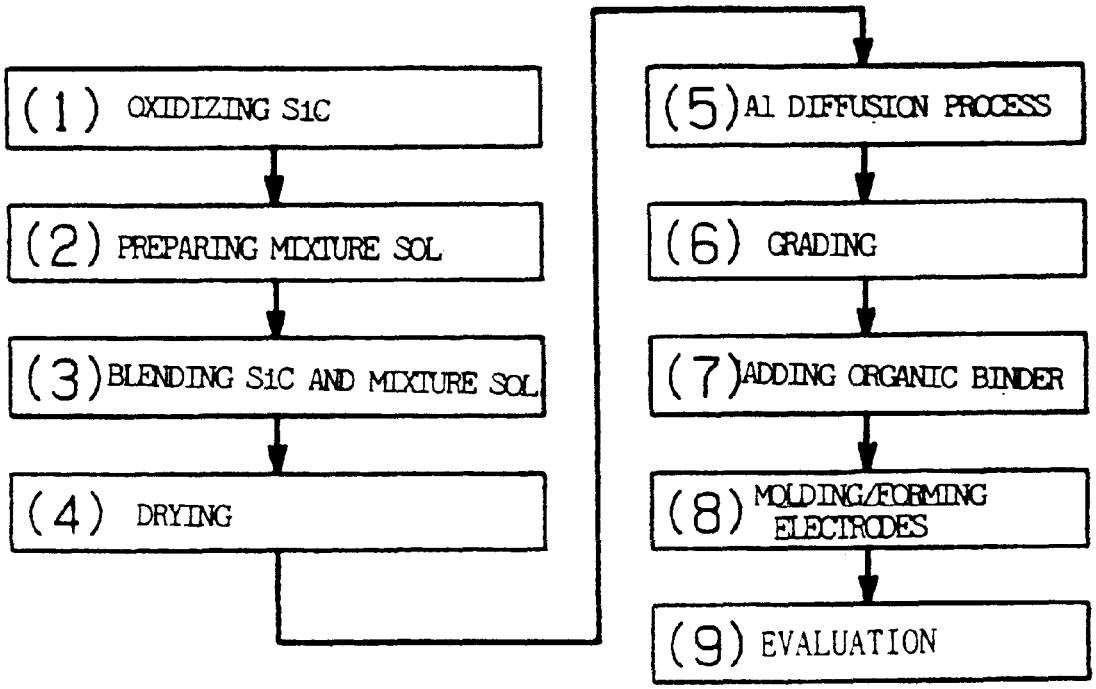
FIG. 1 is a flowchart showing steps for making a nonlinear resistor of the present invention.

In order to evaluate the varistor characteristics of the resulting nonlinear powders, test pieces of single-layer varistors were prepared by mixing the voltage non-linear resistance powder and an organic binder, pressing the mixture at a pressure of 3 t/cm$^2$ performing a uniaxial press molding, heat curing the resulting compact at a temperature in the range of 100° C. to 200° C., and applying external electrodes on the upper and lower surfaces of the cured compact. FIG. 1 is a flowchart showing the steps of making the test pieces of single-layer varistors.

The varistors were evaluated as follows. As for the varistor characteristics, a voltage at both ends of the varistor was measured using a DC current and the voltage at a current of 0.1 mA was defined as the varistor voltage $V_{0.1mA}$. The voltage nonlinearity coefficient a was calculated by equation (1) below using $V_{0.01mA}$, which is the voltage at a current of 0.01 mA, and the above-described varistor voltage $V_{0.1mA}$. The electrostatic capacitance was measured at 1 MHZ.

$$\alpha=1/\mathrm{Log}(V_{0.1mA}/V_{0.01mA}) \quad (1)$$

The apparent relative dielectric constant $\in_r$ was calculated by equation (2) below using the measured value of the electrostatic capacitance:

$$\in_r=C\times d/(\in_0 S) \quad (2)$$

wherein $\in_0$ represents the dielectric constant in vacuum, C represents the electrostatic capacitance, S represents the electrode area and d represents the distance between electrodes.

All the test pieces according to the present invention exhibited a relative dielectric constant at 1 MHZ in the range of 3 to 7.

Figure 2:
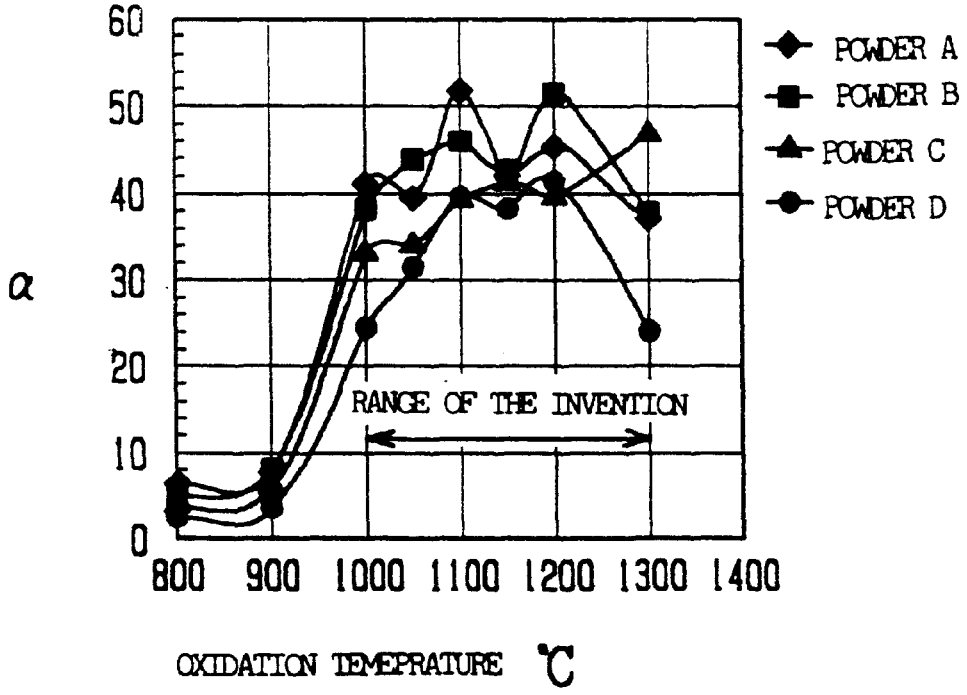
FIG. 2 is a graph showing measurement results of voltage nonlinearity coefficient a of powders A to D.

As for the evaluation results of the varistor characteristics of powders A to D, the voltage nonlinearity coefficient a of each powder was as shown in FIG. 2. As shown in FIG. 2, the test pieces oxidized at a temperature in the range of about 1,000 to 1,300° C. exhibited high nonlinearity, namely, a voltage nonlinearity coefficient α of 20 or greater. In contrast, the test pieces oxidized at a temperature of less than about 1,000° C. or more than about 1,300° C. did not exhibit high nonlinearity.

The test pieces oxidized at a temperature of less than about 1,000° C. had a voltage nonlinearity coefficient α of 7 or less, which is the same as that of conventional SiC varistors. The test pieces oxidized at a temperature exceeding about 1,300° C. either discharged during the measurement or insulated the electrodes, and thus were not measurable.

The reasons for such results are as follows. When the oxidation temperature was less than about 1,000° C., the oxide layer formed on the surface of the particle during the oxidation step was so thin that a potential barrier which yields a high nonlinearity cannot be generated between the adjacent SiC particles which contact each other. Therefore, the nonlinearity thereof was only as good as that of the conventional SiC varistor.

In contrast, when the oxidation temperature exceeded about 1,300° C., the oxide layer formed on the surface of the particle was so thick that the oxide layer functioned as an insulator between the adjacent particles. Because of these reasons, the test pieces oxidized at a temperature exceeding about 1,300° C. exhibited insulation characteristics and discharged when the distance between electrodes of the measured piece was short, whereas the test pieces oxidized at a temperature in the range of about 1,000 to 1,300° C. had an appropriate thickness and exhibited high nonlinearity. It can be concluded from the above that the preferred range of the oxidation temperature is between about 1,000° C. and 1,300° C.

Next, the rate of change in weight of SiC particles before and after the oxidation of the SiC powders was determined so as to determine the range of the SiC oxidation rate which achieves high nonlinearity. Herein, the rate of change in weight of SiC before and after the oxidation AM (%) was obtained from equation (3) below.

$$\Delta M=\{(M2-M1)/M1\}\times 100 \quad (3)$$

wherein M1 represents the weight of the SiC particles before the formation of the oxide layer on the surface of the SiC particle and M2 represents the weight of the SiC particles after the formation of the oxide layer on the surface of the SiC particle.

Figure 3:
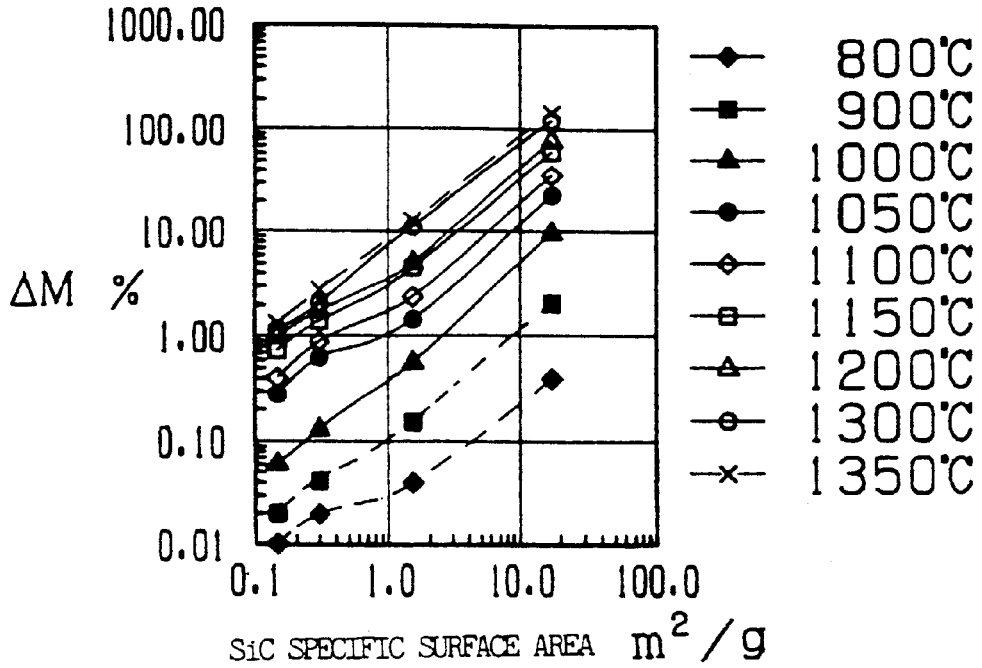
FIG. 3 is a graph showing the rate of change in weight after SiC oxidation.
Figure 4:
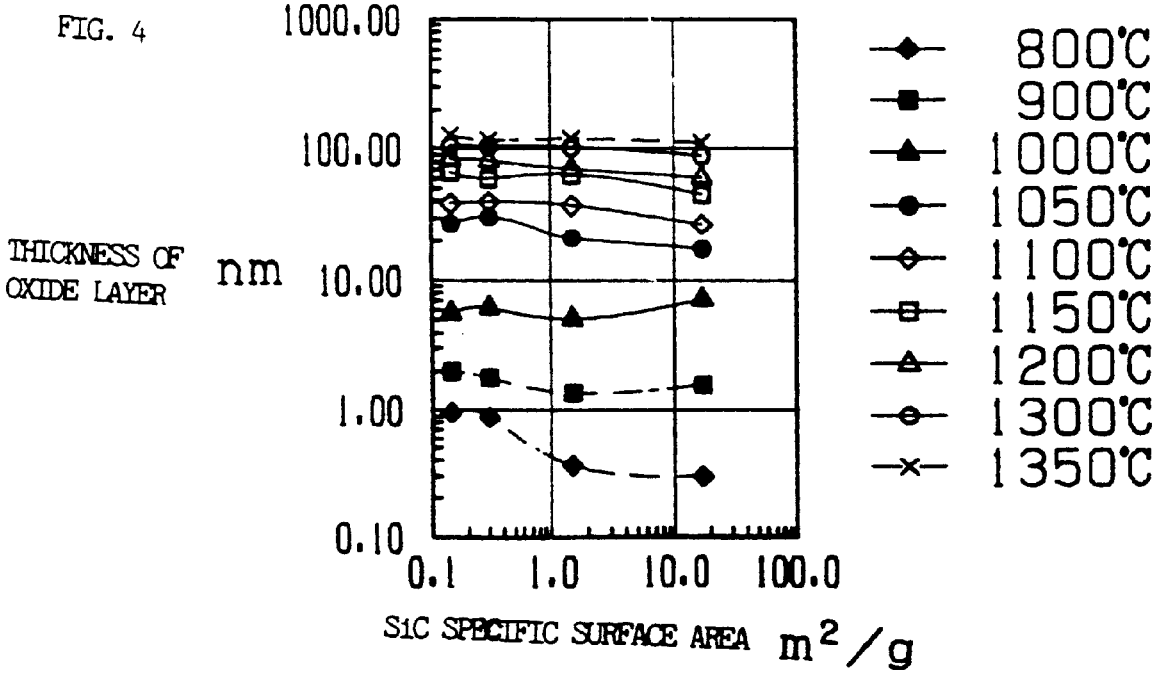
FIG. 4 is a graph showing the thickness of an oxide layer on the surface of silicon carbide.

FIG. 3 shows the oxidation rate of powders A to D according to the respective oxidation temperatures. The thickness of the oxide layer formed on the surface of the SiC particle was calculated from the specific surface area and the rate of change in weight ΔM of the respective powders was as shown in FIG. 4. The abscissa of each graph in FIGS. 3 and 4 indicates the SiC specific surface area (m$^2$/g) of the powder.

As is apparent from FIG. 3, an increase in the oxidation temperature resulted in the increase in an oxidation rate. Also, even when the oxidation conditions were set to be the same, the oxidation rate changed significantly according to the specific surface area of the SiC powder. In other words, the larger the specific surface area, i.e., the smaller the SiC particle, the larger the oxidation rate. Furthermore, according to the results shown in FIG. 2, there existed an optimum range of the oxidation rate required to achieve high nonlinearity, and this range depended on the specific surface area, i.e., the particle diameter of the SiC powder.

As is apparent from FIG. 4, the thickness of the oxide layer of particles achieving high nonlinearity is about 5 to 100 nm and does not depend on the SiC specific surface area.

Based on the results shown in FIG. 3, approximate expressions of the oxidation rates when the oxidation was conducted at a temperature of 1,000° C. and 1,300° C. were obtained. Equation (4) below was obtained for the oxidation temperature of 1,000° C.

$$\Delta M=0.01\times S2+0.37\times S \quad (4)$$

Equation (5) below was obtained for the oxidation temperature of 1,300° C.

$$\Delta M=7.34\times S \quad (5)$$

Here, S represents the specific surface area of the SiC powder ($m^2/g$). Equation (6) expressing the range of the oxidation rate required to obtain high nonlinearity was obtained from equations (4) and (5) as follows.

$$0.01\times S2+0.37\times S\leqq DM\leqq 7.34\times S \quad (6)$$

Herein, the range of S can be determined from the specific surface area of the SiC powder used in the examples as follows.

$$0.14\leqq S\leqq 18.03 \quad (7)$$

Figure 5:
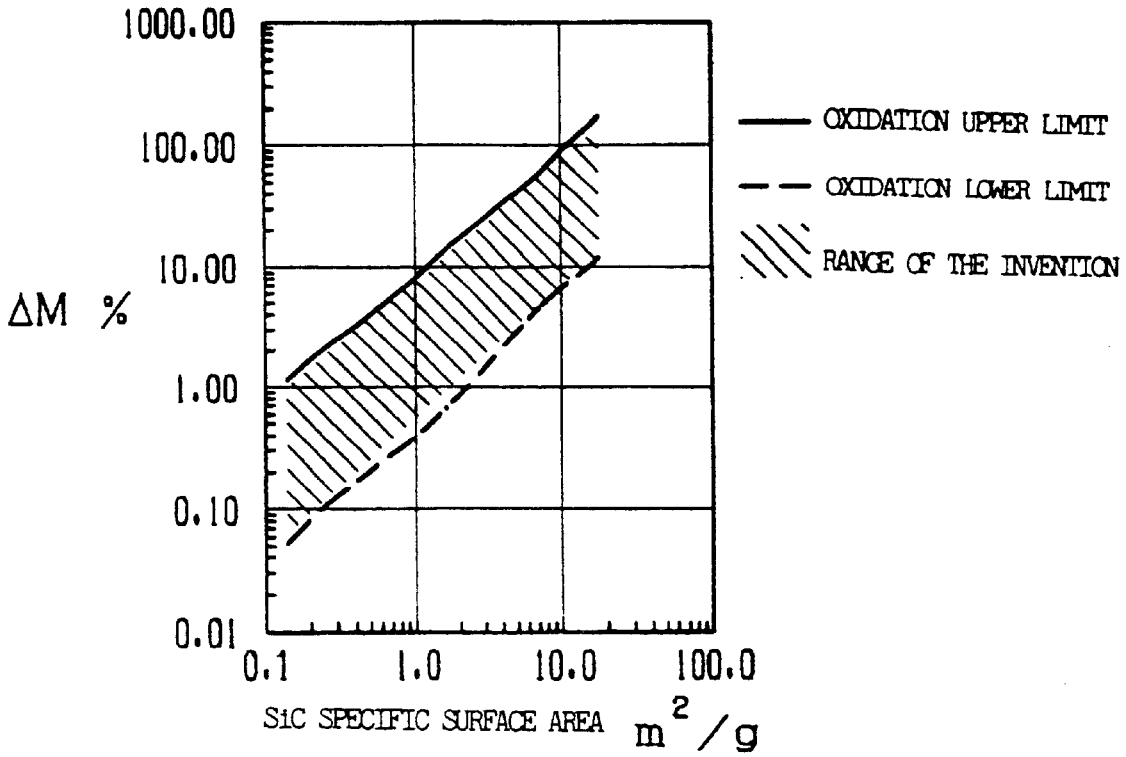
FIG. 5 is a graph showing the preferred range of the oxidation rate according to the present invention.

The range of SiC oxidation rates obtained using equations (4) and (5) is shown in FIG. 5.

In view of the above, it is necessary to control the range of oxidation in order to achieve high nonlinearity. This range changes according to the specific surface area of the SiC powder used and is preferably kept within the range obtained from equation (6). The thickness of the oxide layer formed on the SiC particle was about 5 to 100 nm when the above-described range shown in FIG. 5 was satisfied.

EXAMPLE 2

As shown in Table 3, test pieces of varistors were prepared through manufacturing steps (1) to (9) shown in FIG. 1 while the oxidation temperature was kept within the range of 1,000 to 1,300° C. and the Al diffusion temperature was kept in the range of 950 to 1,450° C., as shown in Table 3. The mixture sol was added to each of the SiC powders at such an amount that Al contained in the mixture sol was 1 percent by weight relative to 100 percent by weight of the SiC powder. The results are shown in Table 4.

TABLE 3

| Lot No. | Oxidation temperature (° C.) | Atmosphere | Diffusion temperature (° C.) | Atmosphere |
|---|---|---|---|---|
| 1* | 1000 | Air | 950 | Ar |
| 2 | 1000 | Air | 1000 | Ar |
| 3 | 1000 | Air | 1150 | Ar |
| 4 | 1000 | Air | 1200 | Ar |
| 5 | 1000 | Air | 1300 | Ar |
| 6 | 1000 | Air | 1400 | Ar |
| 7* | 1000 | Air | 1450 | Ar |
| 8* | 1100 | Air | 950 | Ar |
| 9 | 1100 | Air | 1000 | Ar |
| 10 | 1100 | Air | 1150 | Ar |
| 11 | 1100 | Air | 1200 | Ar |
| 12 | 1100 | Air | 1300 | Ar |
| 13 | 1100 | Air | 1400 | Ar |
| 14* | 1100 | Air | 1450 | Ar |
| 15* | 1200 | Air | 950 | Ar |
| 16 | 1200 | Air | 1000 | Ar |
| 17 | 1200 | Air | 1150 | Ar |
| 18 | 1200 | Air | 1200 | Ar |
| 19 | 1200 | Air | 1300 | Ar |
| 20 | 1200 | Air | 1400 | Ar |
| 21* | 1200 | Air | 1450 | Ar |
| 22* | 1300 | Air | 950 | Ar |
| 23 | 1300 | Air | 1000 | Ar |
| 24 | 1300 | Air | 1150 | Ar |
| 25 | 1300 | Air | 1200 | Ar |
| 26 | 1300 | Air | 1300 | Ar |
| 27 | 1300 | Air | 1400 | Ar |
| 28* | 1300 | Air | 1450 | Ar |

Note: Asterisked test pieces are not within the range of the present invention.

TABLE 4

| Lot No. | Varistor voltage (V/mm) | Voltage nonlinearity coefficient α |
|---|---|---|
| 1* | — | — |
| 2 | 2020 | 30 |
| 3 | 2000 | 35 |
| 4 | 1870 | 32 |
| 5 | 1600 | 27 |
| 6 | 1520 | 21 |
| 7* | 160 | 5.2 |
| 8* | — | — |
| 9 | 2240 | 35 |
| 10 | 2005 | 43 |
| 11 | 2010 | 38 |
| 12 | 1982 | 30 |
| 13 | 1804 | 22 |
| 14* | 132 | 7.1 |
| 15* | — | — |
| 16 | 2250 | 30 |
| 17 | 2180 | 44 |
| 18 | 2100 | 40 |
| 19 | 2050 | 38 |
| 20 | 1980 | 26 |
| 21* | 720 | 7.8 |
| 22* | — | — |
| 23 | 2800 | 51 |
| 24 | 2420 | 43 |
| 25 | 2250 | 40 |
| 26 | 2090 | 45 |
| 27 | 2010 | 32 |
| 28* | 1108 | 6.8 |

Note: Asterisked samples are not within the range of the present invention.

As shown in Tables 3 and 4, when the Al diffusion process was conducted at a temperature in the range of about 1,000° C. to 1,400° C., the resulting test pieces exhibited high nonlinearity. When the Al diffusion temperature was 950° C., the resulting test pieces exhibited an insulating property and a discharge property and did not have the varistor characteristic. When the Al diffusion temperature was 1,450° C., the resulting test pieces had a varistor characteristic but the nonlinear coefficient α thereof was approximately 7, which is the same as that of the conventional SiC varistors.

The reasons for such results are as follows. In the Al diffusion process at a temperature of 950° C., Al did not sufficiently diffuse into the oxide layers formed on the surface of the SiC particles. As a consequence, oxide layers not containing a sufficient amount of Al have come into contact and form particle boundaries, or particle boundaries are formed such that oxides of Al and Si were present between the adjacent particles. Thus, the particle boundaries were electrically isolated, failing to achieve the desired characteristics. In contrast, when the Al diffusion process was performed at a temperature of 1,450° C., an excessive amount of Al was diffused into the oxide layers, thereby giving dielectric characteristics to the oxide layers formed on the surface of the SiC particles and decreasing nonlinearity. Thus, the amount of Al diffusion is required to be controlled by controlling the Al diffusion temperature, and the preferable range of the Al diffusion temperature is between about 1,000° C. and 1,400° C.

As is apparent from the description above, a SiC-based varistor achieving a voltage nonlinearity coefficient a of the same level as that of the conventional ZnO varistors as well as a low apparent relative dielectric constant can be made from the SiC powder of the present invention. The SiC powder of the present invention is suitable as the material varistors material.

Moreover, according to the manufacturing method of the present invention, the conditions for the step of forming an oxide layer on the surface of a SiC particle and the conditions for the step of dispersing Al in the vicinity of the SiC particle surface and thereby forming a potential barrier can be controlled individually. Thus, the stability of the characteristics can be improved.

What is claimed is:

1. A voltage non-linear resistor comprising impurity doped semiconductive SiC particles, wherein said semiconductive SiC particles having an oxide layer on the surface thereof and the oxide layer has a thickness in the range of about 5 to 100 nm, and wherein aluminum is diffused into the oxide layer.

2. A voltage non-linear resistor according to claim 1, wherein said particles are characterized by a rate of change in weight of the semiconductive SiC particles ΔM with respect to a specific surface area S ($m^2/g$) of the semiconductive SiC particles which satisfies the relationship:

$$0.01\times S^2+0.37\times S \leqq \Delta M \leqq 7.34\times S$$

wherein ΔM (=%) {(M2−M1)/M1}×100, M1 represents the weight of the semiconductive SiC particles before the formation of the oxide layer and M2 represents the weight of the semiconductive SiC particles after the formation of the oxide layer.

3. A voltage non-linear resistor according to claim 2 in the form of a body having electrodes thereon, thereby forming a varistor.

4. A voltage non-linear resistor according to claim 1 in the form of a body having electrodes thereon, thereby forming a varistor.

* * * * *